US011014363B2

(12) United States Patent
Kage et al.

(10) Patent No.: US 11,014,363 B2
(45) Date of Patent: May 25, 2021

(54) METHOD AND COVER FOR CLEANING A PRINT HEAD

(71) Applicant: Océ Holding B.V., Venlo (NL)

(72) Inventors: Matthias Kage, Haar (DE); Ender Olgac, Magdeburg (DE); Christoph Stadler, Dachau (DE); Mehrad Biglari, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/502,054

(22) Filed: Jul. 3, 2019

(65) Prior Publication Data

US 2020/0009869 A1 Jan. 9, 2020

(30) Foreign Application Priority Data

Jul. 6, 2018 (DE) ..... 10 2018 116 376.2

(51) Int. Cl.
*B41J 2/165* (2006.01)

(52) U.S. Cl.
CPC ..... *B41J 2/16538* (2013.01); *B41J 2/16505* (2013.01)

(58) Field of Classification Search
CPC .. B41J 2/16538; B41J 2/16505; B41J 25/304; B41J 2/16508; B41J 2/16585
See application file for complete search history.

(56) References Cited

U.S. PATENT DOCUMENTS

| | | | | |
|---|---|---|---|---|
| 6,364,449 | B1 | 4/2002 | Takahashi et al. | |
| 6,494,560 | B1 | 12/2002 | Seshimo et al. | |
| 2009/0219335 | A1 | 9/2009 | Furukawa | |
| 2014/0292918 | A1 * | 10/2014 | Shimizu | B41J 2/16552 347/33 |

FOREIGN PATENT DOCUMENTS

| | | | | |
|---|---|---|---|---|
| CA | 2588625 | C | 8/2010 | |
| DE | 69927071 | T2 | 6/2006 | |
| DE | 102013217685 | A1 | 3/2015 | |
| DE | 10 2014 106 348 | A1 * | 11/2015 | B41J 2/165 |
| EP | 1090764 | A1 | 4/2001 | |
| EP | 1827841 | B1 | 9/2009 | |
| JP | 2003011377 | A | 1/2003 | |
| JP | 2006123240 | A | 5/2006 | |

OTHER PUBLICATIONS

German Office Action dated Feb. 6, 2019, Application No. 20 2018 116 376.2.

* cited by examiner

*Primary Examiner* — Geoffrey S Mruk
(74) *Attorney, Agent, or Firm* — Schiff Hardin LLP

(57) ABSTRACT

A cover for covering the nozzle plate of a print head while in a parking position to delay a drying of ink. The cover can clean the nozzle plate while the nozzle plate is covered. A cost-effective and installation space-efficient cleaning of the nozzle plate of a print head is thus enabled.

13 Claims, 3 Drawing Sheets

METHOD AND COVER FOR CLEANING A PRINT HEAD

CROSS REFERENCE TO RELATED APPLICATIONS

This patent application claims priority to German Patent Application No. 102018116376.2, filed Jul. 6, 2018, which is incorporated herein by reference in its entirety.

BACKGROUND

Field

The disclosure relates a method and a cover for cleaning the nozzle plate of a print head of an inkjet printer.

Related Art

An inkjet printer for printing to a recording medium includes one or more print heads having respectively one or more nozzles. The nozzles are respectively configured to eject ink droplets in order to print dots of a print image onto the recording medium. The printing process of an inkjet printer may be interrupted in order to clean the one or more print heads. The one or more print heads may be driven laterally to the side of the recording medium, from a printing position into a cleaning position, for cleaning of said print heads.

The movement of a print head into a cleaning position typically takes a relatively long period of time, and thus reduces the productivity of a printer. Furthermore, the provision of a dedicated cleaner at the cleaning position of a printer leads to an increased installation space and to additional costs.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
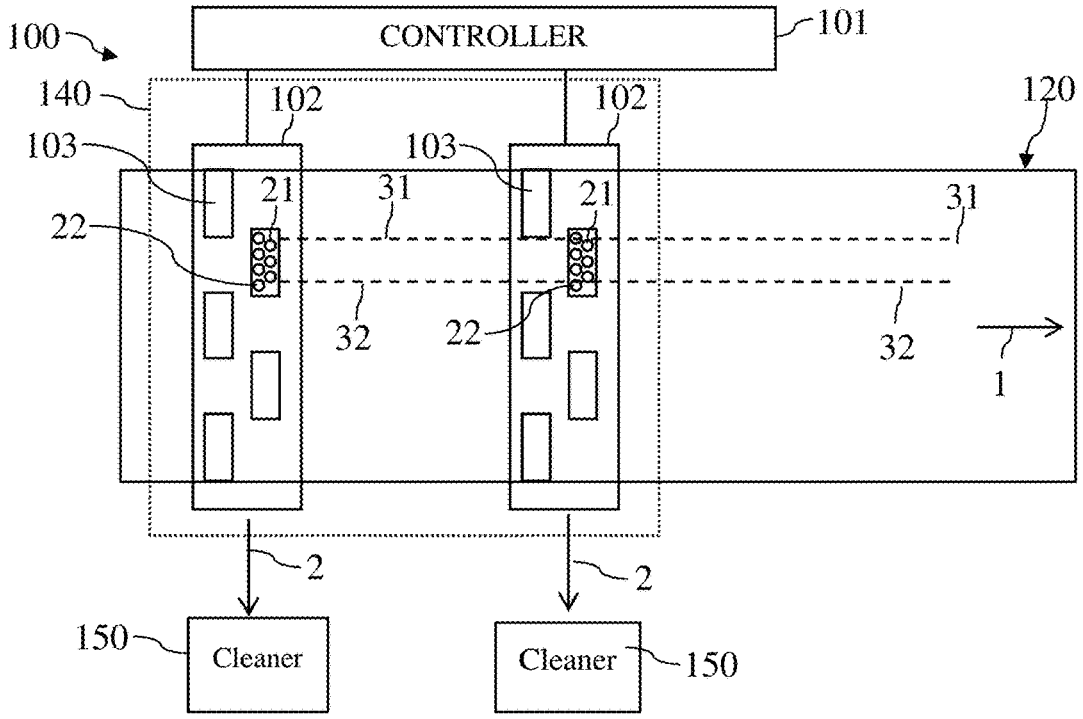

FIG. 1*a* is a block diagram of an inkjet printer according to an exemplary embodiment.

Figure 1B:
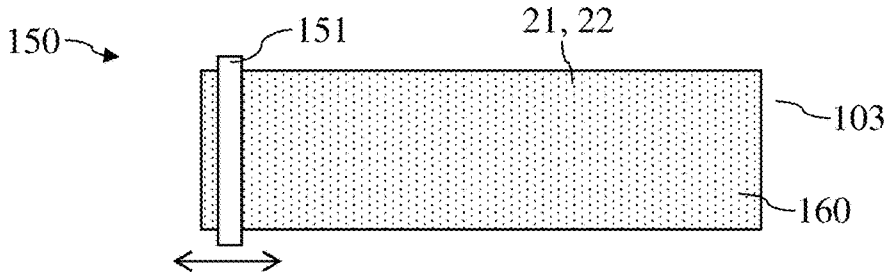

FIG. 1*b* illustrates a cleaner of an inkjet printer according to an exemplary embodiment.

FIGS. 2*a* through 2*d* illustrate different states of a cover for a print head in different states according to an exemplary embodiment.

Figure 3A:
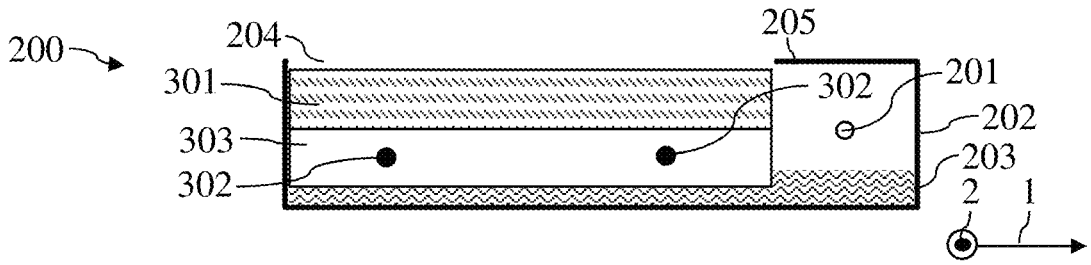
Figure 3B:
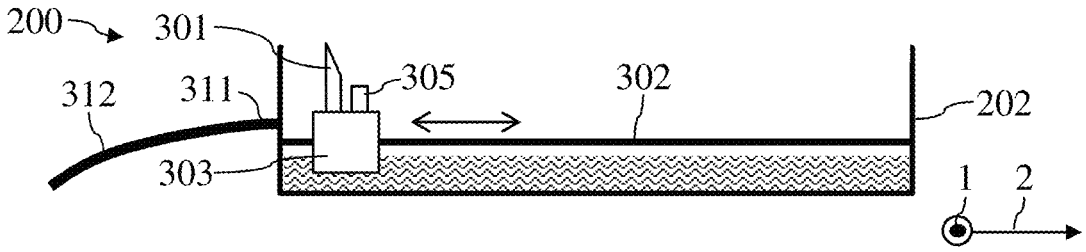
Figure 3C:
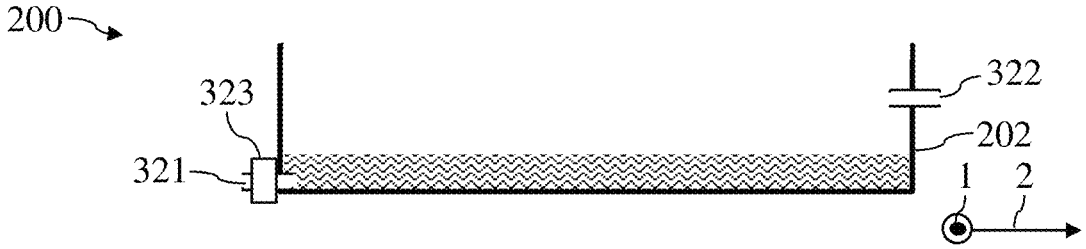

FIGS. 3*a* through 3*c* illustrates a cover having a cleaner according to an exemplary embodiment.

Figure 4:
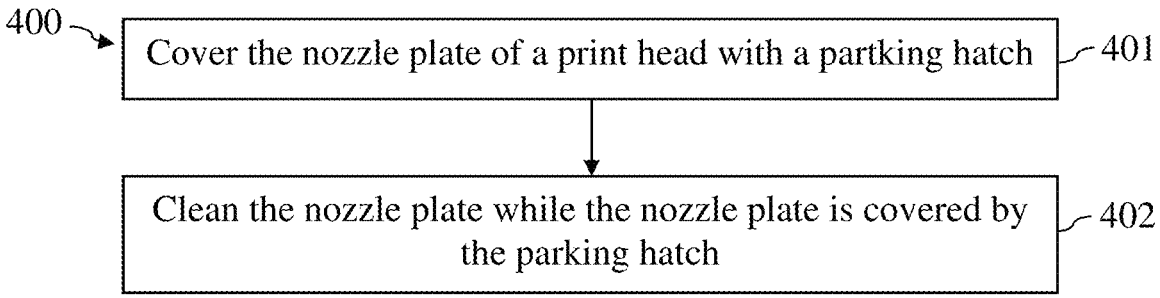

FIG. 4 illustrates a workflow of a method for cleaning the nozzle plate of a print head according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure it to enable a cost-, time-, and space-efficient cleaning of the one or more print heads of an inkjet printer.

According to an aspect of the disclosure, a cover is described for a print head of an inkjet printer. The cover is configured to cover a nozzle plate of a print head in order to delay a drying of ink in the print head. Moreover, the cover is configured to clean the nozzle plate, in particular to wipe off the nozzle plate, while the nozzle plate is covered.

According to a further aspect of the disclosure, a method is described for cleaning a nozzle plate of a print head of an inkjet printer. The method includes the coverage of the nozzle plate with a cover, for instance a parking hatch, in order to delay a drying of ink in the print head. Moreover, the method includes the cleaning, in particular the wiping, of the nozzle plate while the nozzle plate is covered by the cover.

With reference to FIG. 1*a*, an inkjet printer 100 according to an exemplary embodiment is illustrated. In an exemplary embodiment, the printer 100 is configured to print to a recording medium 120 in the form of a sheet, page, plate, or belt. The recording medium 120 may be made of paper, paperboard, cardboard, metal, plastic, textiles, a combination thereof, and/or other materials that are suitable and can be printed to. The recording medium 120 is directed along the transport direction 1 (represented by an arrow) through the print group 140 of the printer 100. The printer 100 can be configured to print to other types of recording mediums 120 as would be understood by one of ordinary skill in the art.

In the depicted example, the print group 140 of the printer 100 comprises two print bars 102, wherein each print bar 102 may be used for printing with ink of a defined color (for example black, cyan, magenta, and/or yellow, and/or Magnetic Ink Character Recognition (MICR) ink). Different print bars 102 may be used for printing with respective different inks. Furthermore, the printer 100 typically comprises at least one fixing or dryer (not shown) that is configured to fix a print image printed onto the recording medium 120.

A print bar 102 may include one or more print heads 103 that are possibly arranged in multiple rows side by side in order to print the dots of different columns 31, 32 of a print image onto the recording medium 120. In the example depicted in FIG. 1*a*, a print bar 102 comprises five print heads 103, wherein each print head 103 prints the dots of a group of columns 31, 32 of a print image onto the recording medium 120.

In the embodiment depicted in FIG. 1*a*, each print head 103 of the print group 140 includes a plurality of nozzles 21, 22, where each nozzle 21, 22 is configured to fire or eject ink droplets onto the recording medium 120. For example, a print head 103 of the print group 140 may include multiple thousands of effectively used nozzles 21, 22 that are arranged along multiple rows transversal to the transport direction 1 of the recording medium 120. By means of the nozzles 21, 22 of a print head 103 of the print group 140, dots of a line of a print image may be printed onto the recording medium 120 transversal to the transport direction 1, meaning along the width of the recording medium 120.

In an exemplary embodiment, the printer 100 also includes a controller 101 (e.g. an activation hardware) that is configured to activate the actuators of the individual nozzles 21, 22 of the individual print heads 103 of the print group 140 in order to apply a print image onto the recording medium 120 depending on print data. In an exemplary embodiment, the controller 101 includes processor circuitry that is configured to activate the actuators of the nozzles 21, 22. In an exemplary embodiment, the controller 101 is configured to control one or more operations and/or functions of the printer 100.

The print group 140 of the printer 100 thus includes at least one print bar 102 having K nozzles 21, 22 that may be activated with a defined line clock pulse in order to print a line that travels transversal to the transport direction 1 of the recording medium 120, with K pixels or K columns 31, 32 of a print image, onto the recording medium 120, for example with K>1000. In the shown example, the nozzles 21, 22 are installed immobile or fixed in the printer 100, and the recording medium 120 is directed past the stationary nozzles 21, 22 with a defined transport velocity.

In an exemplary embodiment, the printer 100 includes one or more cleaners 150. A print bar 102 may be transitioned from a printing position, at which the print bar 102 is arranged above the recording medium 120, into a cleaning position at a cleaner 150. For this purpose, the print bar 102 may be moved in the movement direction 2 indicated by an arrow that is transversal to the transport direction 1 of the recording medium 120. The printer 100 may have a cleaner 150 for each print bar 102. In an alternative embodiment, the print bar may be moved parallel to the transport direction 1 to the cleaner 150. That is, the cleaner.

FIG. 1*b* shows the underside of the nozzle plate 160 of a print head 103 of a print bar 102 at a cleaner 150. The outputs of the one or more nozzles 21, 22 of the print head 103 are arranged at the underside or the nozzle plate 160 of the print head 103. In the cleaning position, the one or more nozzles 21, 22 of the print head 103 may be induced to eject ink, for example by increasing the (resting) pressure within the one or more nozzles 21, 22. This step may be referred to as "purging". The cleaner 150 may also be configured to spray the nozzle plate 160 of a print head 103 with a cleaning fluid. The underside 160 of the print head 103 may subsequently be cleaned with a wiper 151. The wiper 151 may be moved across the nozzle plate 160 in the direction indicated by the double arrow in order to clean the nozzle plate 160. This step may be referred to as "wiping". The direction indicated by the double arrow thereby typically travels parallel to the movement direction 2.

The transition of a print head 103 or of a print bar 102 into the cleaning position is linked with a relatively high time cost. Furthermore, a cleaner 150 typically takes up a relatively large amount of installation space, and is linked with additional costs.

In an exemplary embodiment, the printer 100 includes a cover 200. The cover 200 may be included for every single print head 103 or for the print heads 103 of a print bar 102, or a subset thereof. In an exemplary embodiment, the cover 200 is configured to cover the nozzle plate 160 of at least one print head 103 if the printer 100 is in a rest mode (see FIGS. 2*a* through 2*d*). The cover 200 of a print head 103 may be designed as a hatch that may be folded over the nozzle plate 160 or be folded away from the nozzle plate 160 of the print head 103 (as depicted in FIGS. 2*a* through 2*d*). The cover 200 may therefore also, if applicable, be referred to as a parking hatch or as a protective hatch.

With reference to FIGS. 2*a*-2*d*, in an exemplary embodiment, the cover 200 includes a container 202 with an opening 204, where the nozzle plate 160 of a print head 103 may be directed through the opening 204 into or onto the container 202. In particular, the opening 204 of the container 202 may be designed such that the container 202 may be sealed by the nozzle plate 160 of a print head 103 in order to form an in particular fluid-tight sealed container 202 if the nozzle plate 160 has been directed into or onto the container 202. The nozzle plate 160 of a print head 103 in this instance represents a portion of the wall of the container 202, and faces toward the interior of the container 202.

The cover 200 may be configured to provide specific climatic conditions for the nozzle plate 160 of a print head 103, via which the drying of ink in the nozzles 21, 22 of the print head 103 may be at least slowed or reduced. In particular, the interior of the container 202 of the cover 200 may have a climate control fluid 203 via which specific climatic conditions may be produced in the interior of the container 202 of the cover 200. For example, a relatively high humidity may be produced by the climate control fluid 203, in comparison to the humidity outside of the container 202 of the cover 200. The functionality of a print head 103 may thus be reliably and efficiently preserved over relatively long rest time periods.

Figure 2A:
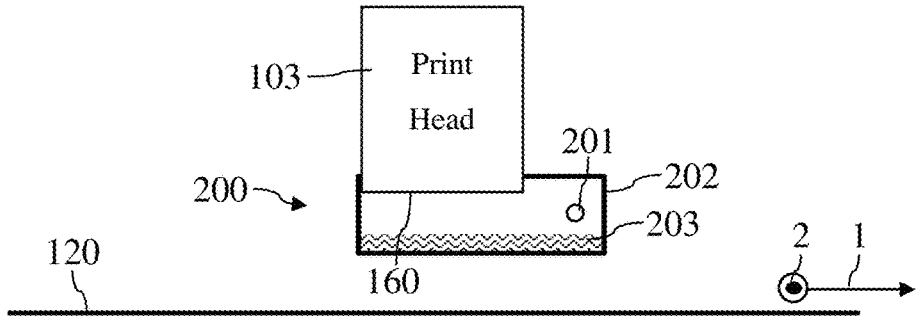

FIG. 2*a* shows a print head 103 in a view orthogonal to the transport direction 1 and along the movement direction 2. The print head 103 has a nozzle plate 160 that is covered by the cover 200. The print head 103 is thus located in a rest mode, or in a rest or parking position, in which the cover 200 is configured to reduce or prevent the ink within the print head 103 from drying out, or slows the drying out of the ink.

Figure 2B:
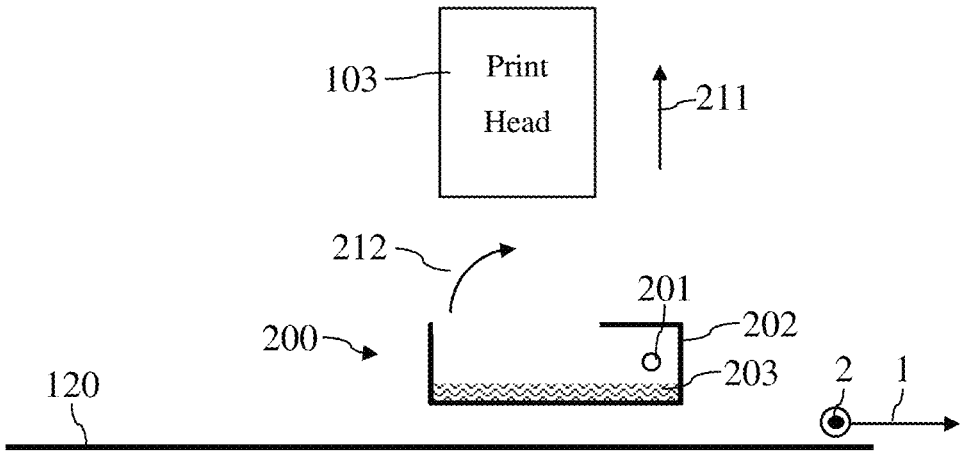
Figure 2C:
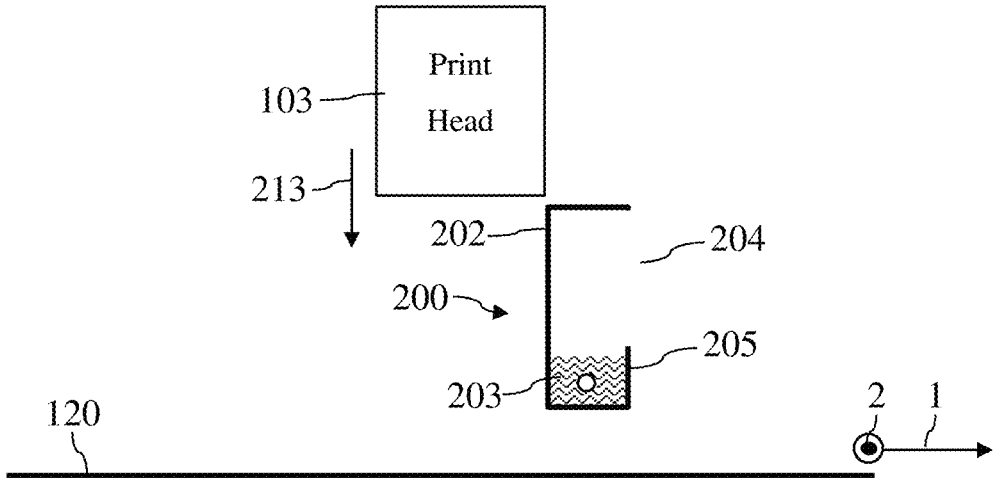
Figure 2D:
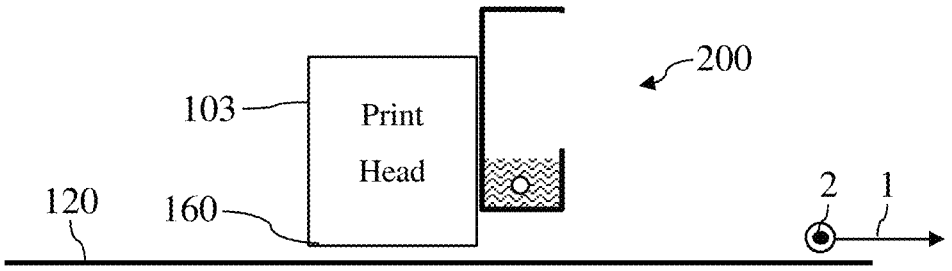

In an exemplary embodiment, in order to transition the print head 103 into a printing mode or into a printing position, the print head 103 is raised in a rise (upward) direction 211 so that the container 202 of the cover 200 may be moved to an upright position along the rotation direction 212 around the rotation axle 201 of the container 201 (see FIG. 2*b*). The container 202 of the cover 200 may then be stood up so that the upright container 202 is arranged in an upright position and located before or after the print head 103 in the transport direction 1 of the recording medium 120, as depicted in FIG. 2*c*. The print head 103 may then be lowered along the fall (downward) direction 213 adjacent to the upright container 202 in order to position the nozzle plate 160 of the print head 103 directly above the recording medium 120, as depicted in FIG. 2*d*. In an exemplary embodiment, only a relatively small nip that is 2 mm, 1 mm, or even smaller, for example, is then located between the nozzle plate 160 and the recording medium 120. The print head 103 is then located in a printing position as illustrated in FIG. 2*d*. As illustrated in FIGS. 2*a* through 2*d*, the print head 103 may be moved back and forth between a rest/parked position and a printing position via an efficient translation movement, in particular an up-down movement.

In an exemplary embodiment, the container 202 of the cover 200 includes a wall segment 205 to the side of the opening 204 for the nozzle plate 160 of a print head 103 and at the end at which the rotation axle 201 is arranged. The wall segment 205 is designed such that the upright container 202 forms a basin for receiving the climate control fluid 203, in particular to receive the climate control liquid. It may thus be ensured that the climate control fluid 203 remains in the container 202 even when the container 202 is in the exhibited (upright) state.

In an exemplary embodiment, the cover 200 is configured to clean the covered nozzle plate 160 of a print head 103. In particular, the cover 200 may be configured to take over the cleaning function of a cleaner 150. For example, the cleaning mechanism of a cleaner 150 may be installed in the cover 200. The installation of a separate cleaner 150 may thus be omitted, so that the costs and the installation space of a printer 100 may be reduced. Furthermore, the time cost for moving a print head 103 into a cleaning position may thus be saved, so that the productivity of a printer 100 may be increased.

FIGS. 3*a* and 3*b* illustrates an exemplary embodiment of a cover 200 that includes a wiper 301 with which the nozzle plate 160 of a print head 103 covered with the cover 200 may be cleaned, in particular wiped off. FIG. 3*a* thereby shows the cover 200 in a view along the movement direction 2 and orthogonal to the transport direction 1. FIG. 3*b* shows the cover 200 in a view along the transport direction 1 and orthogonal to the movement direction 2.

In an exemplary embodiment, the wiper 301 has a width that is greater than or equal to the width of the nozzle plate 160 to be cleaned. The term "width" in this instance thereby relates to an extent of the nozzle plate 160 in the transport direction 1. The wiper 301 may be attached to a wiper mount 303. The wiper mount 303 may be moved along the movement direction 2 on one or more guide rails 302 in order to wipe off the nozzle plate 160 of a print head 103. The movement of the wiper mount 303 may be produced by an electric motor. The ink that is wiped off in the wiping process may then drip from the nozzle plate 160 into the interior of the container 202 of the cover 200.

In an exemplary embodiment, the cover 200 includes an applicator 305, for example, a spray nozzle, that is configured to apply—in particular to spray—cleaning fluid onto the nozzle plate 160 of a print head 103. The applicator 305 may, for example, be arranged or fixed at the wiper mount 303. Cleaning fluid may thus be applied onto the nozzle plate 160, possibly before wiping off said nozzle plate 160, in order to increase the quality of the cleaning of the nozzle plate 160. The applicator 305 may have an electrical actuator in order to apply cleaning fluid onto the nozzle plate 160 of a print head 103.

In an exemplary embodiment, the container 202 of the cover 200 includes a spillover opening or a drain 311 via which the fluid may flow out of the interior of the container 202. For example, a spillover line or a drain line 312, for instance a hose, may be arranged at the spillover opening 311 in order to conduct the fluid away from the container 200. The spillover opening 311 may be arranged at a wall of the container 202 such that the quantity of fluid in the interior of the container 202 is limited to a value that may still be received by the basin formed in the upright state of the container 202 without the fluid running out of said container 202.

FIG. 3*c* shows a cover 200 that has an inflow 322 and an outflow 321 for fluid in the interior of the container 202 according to an exemplary embodiment. The inflow 322 may be used to direct fresh climate control fluid 203 into the interior of the container 202. The outflow 321 may be closed or opened by an outflow valve 323. The fluid in the interior of the container 202, for example a mixture of cleaning fluid, ink, and/or climate control fluid 203, may thus possibly be entirely conveyed out of the container 202. If applicable, a cleaning of the interior of the container 202 may be enabled via the provision of an inflow 322 and/or an outflow 321.

A cover 200 is thus described via which the functions of cleaning and parking may be combined. In particular, for this purpose a purge-&-wipe mechanism may be integrated into the parking hatch of a print head 103. The functions of cleaning and parking may thus be provided, but with a reduced installation space.

FIG. 2*a* depicts a print head 103 that is located in a parking position in which the print head 103 is positioned in a parking hatch 200, in particular in the opening 204 of a parking hatch 200. A climate control fluid 203, for example cleaning fluid, may be located in the parking hatch 200 in order to generate a microclimate and thus reduce an evaporation of the ink from the print head 103 during the parking.

In a cleaning process, ink may be purged from a print head 103 by means of overpressure in the parking hatch 200, in particular in the container 202 of the parking hatch 200, on the climate control fluid 203. Ink residues may subsequently be wiped from the nozzle plate 160 of the print head 103 with the aid of a wiper 301. Furthermore, the wiper 301 may be cleaned after the wiping process. Ink mixed with the climate control fluid 203 is then located in the parking hatch 200, in particular in the container 202 of the parking hatch 200. This mixture may be discharged via a spillover 311 and/or via a drain 321 into a waste container. A certain residual quantity of fluid may thereby remain in the container 202 of the parking hatch 200 in order to continue to maintain the microclimate in the interior of the container 202 of the parking hatch 200.

In order to keep the concentration of the climate control fluid 203 in the container 202 of the parking hatch 200 at a specific concentration value, new climate control fluid 203 may be filled into the container 202 of the parking hatch 200, for example via an inlet 322. The supply of new climate control fluid 203 may be used in order to flush the purged ink from the container 202 into the waste container by means of the newly supplied climate control fluid 203.

A vertical movement 211 of the print head 103 out of the parking hatch may be executed in order to bring the print head 103 into the printing position. The parking hatch 200 may then be mechanically pivoted away together with the wiping mechanism, as indicated by the rotation movement 212, so that in a further vertical movement 213 the print head 103 may be moved past the pivoted-away parking hatch 200 toward the recording medium 120.

Moreover, a sliding mechanism may be provided that enables a print head 103 to be displaced out of the printing position along the movement direction 2. A manual servicing of a print head 103 may thus be comfortably enabled.

In an exemplary embodiment, the cover 200 is configured to cover the nozzle plate 160 of at least one print head 103 in order to delay a drying of ink in the print head 103. In an exemplary embodiment, the cover 200 is configured to cover the nozzle plates 160 of multiple print heads 103. For example, the cover 200 may be configured to cover the nozzle plate 160 of the one or more print heads 103, in particular of all print heads 103, of a print bar 102. The cover 200 may thereby be designed as a parking hatch or as a protective hatch.

In particular, the cover 200 may be configured as a hatch to be pivoted away from the nozzle plate 160 of a print head 103, or to be pivoted below the nozzle plate 160 of the print head 103. For example, the cover 200 may include a container 202 having at least one opening 204. The opening 204 may be designed such that the nozzle plate 160 of a print head 103 may be guided via the opening 204 into the container 202 so that the nozzle plate 160 is covered by the container 202. Alternatively or additionally, the opening 204 may be configured such that the nozzle plate 160 seals the opening 204 of the container 202, in particular seals it fluid-tight. In the event of a cover 200 for a plurality of print heads 103, the container 202 may have an opening 204, possibly precisely one opening 204, for each print head 103. The drying out of ink in a print head 103 may be reliably delayed via the provision of a covering container 202 with one or more openings 204 for the one or more print heads 103 of a print bar 102 of a printer 100.

In an exemplary embodiment, the container 202 of the cover 200 is configured to receive a climate control fluid 203, in particular the climate control liquid, in the interior of the container 202 in order to generate a microclimate for the nozzle plates 160 of the one or more covered print heads 103. By adjusting a microclimate, in particular a humid microclimate, the drying of ink in a print head 103 may be delayed particularly reliably, in particular in comparison to the instance in which the nozzle plates 160 of the one or more print heads 103 are exposed to the ambient air of the printer 100.

In an exemplary embodiment, the cover 200 is configured to be pivoted via a rotation axle 201 toward the one or more print heads 103 to be covered or away from the one or more print heads 103. For example, as depicted in FIGS. 2*a* through 2*d*, the one or more print heads 103 may be directly driven vertically upward from a printing position above a recording medium 120. An upright cover 200 arranged before or after (in the transport direction 1 of the recording medium 120) the one or more print heads 103 may subsequently be pivoted around the rotation axle 201 below the one or more print heads 103 so that the nozzle plates 160 of the one or more print heads 103 are covered by the cover 200. This position may be referred to as a parking or rest position of the one or more print heads 103. The parking or rest position is thus typically arranged directly above a recording medium 120. In particular, the parking or rest position may be arranged vertically above the printing position, starting from the recording medium 120. In other words, for the transition between the printing position and the parking or rest position, the movement of the one or more print heads 103 may be limited to purely a translational movement that may travel orthogonal to the surface of a recording medium 120 to be printed to.

In an exemplary embodiment, the container 202 of the cover 200 includes a wall segment 205 on the side of the one or more openings 204 for the nozzle plates 160 of the one or more print heads 103 to be covered, which wall segment 205 is designed such that the container 202 forms a basin to receive the climate control fluid 203 if the container 202 is pivoted away from the one or more print heads 103, meaning if the container 202 is upright. 205. In the pivoting process of the container 202, the climate control fluid 203 may thus collect in the basin formed by the wall segment so that no climate control fluid 203 flows or drips onto a recording medium 120 arranged below the container 202. A contamination of the printer 100 and/or of a recording medium 120 with climate control fluid 203 may thus be reliably avoided.

In an exemplary embodiment, the cover 200 is also configured to clean the nozzle plates 160 of the one or more print heads 103, in particular to wipe off the nozzle plates 160 of the one or more print heads 103 while the nozzle plates 160 of the one or more print heads 103 are covered, in particular by the container 202 of the cover 200.

A cover 200 is thus described with which the nozzle plate 160 of at least one print head 103 may be covered in a parking position in order to delay a drying of ink. The cover 200 is moreover configured to clean the nozzle plate 160 of the at least one print head 103 while the nozzle plate 160 is covered. A cost-efficient and space-efficient cleaning of the nozzle plate 160 of a print head 103 is thus enabled.

In an exemplary embodiment, the cover 200 includes at least one wiper 301 that is configured to wipe off the nozzle plates 160 of the one or more covered print heads 103. The wiper 301 may thereby be designed such that the wiper 301 may be directed past the nozzle plate 160 of a print head 103, said nozzle plate 160 being arranged at an opening 204 of the container 202, in order to wipe off the nozzle plate 160. The wiper 301 may thereby preferably be arranged within the container 202 of the cover 200, such that ink wiped off of the nozzle plate 160 of a print head 103 falls or drips into the container 202. A particularly reliable and efficient cleaning of the nozzle plate 160 of a print head 103 is enabled via the provision of at least one wiper 301 within the container 202 of a cover 200. In particular, the container 202 of the cover 200 may simultaneously be used as a capture basin for wiped-off ink and/or cleaning fluid and as a cover for a nozzle plate 160.

In an exemplary embodiment, the cover 200 includes a wiper mount 303 to which the at least one wiper 301 is fixed or attached. The cover 200 may include at least one guide rail 302. The at least one guide rail 302 may thereby travel along the nozzle plates 160 of the one or more print heads 103 to be wiped off. In particular, the at least one guide rail 302 may travel transversal to the transport direction 1 of a recording medium 120, or along the movement direction 2.

In an exemplary embodiment, the wiper mount 303 is configured to be directed past the nozzle plates 160 of the one or more print heads 103, along the at least one guide rail 302 within the container 202. The wiper mount 303 may thus be configured to implement a translational movement along the movement direction 2. For this purpose, the wiper mount 303 may have an electric drive that is configured to move the wiper mount 303 along the one or more guide rails 302. A reliable and efficient cleaning of the nozzle plates 160 of the one or more covered print heads 103 may thus be produced.

In an exemplary embodiment, the container 202 includes a drain 311, 321 via which fluid, in particular a fluid mixture of ink, cleaning fluid and/or climate control fluid 203, may be conducted out of the interior of the container 202. The drain 311, 321 may be closed or opened via a drain valve 323. The draining fluid may be conducted away from the container 202 via a drain line 312. The fill level of the container may be reliably adjusted via the provision of a drain 311, 321, in particular in order to avoid a spillover in the upright state of the container 202. For example, the controller 101 of the printer 100 may be configured to open the drain valve 323 following a cleaning process, and/or in preparation for a pivoting away of the cover 200, in order to reduce the fill level of the container 202.

In an exemplary embodiment, the container 202 alternatively or additionally includes an inlet 322 via which climate control fluid 203 may be conducted into the interior of the container 202. The inlet 322 may possibly be opened or closed by an inlet valve. A reliable cleaning of the interior of the container 202 and/or the adjustment of a defined microclimate may be produced via the provision of an inlet 322 for climate control fluid 203. For example, in order to adjust a defined microclimate, the controller 101 of the printer 100 may be configured to conduct fresh climate control fluid 203 into the interior of the container 202 up to a defined fill level, for example if the cover 200 covers the nozzle plates 160 of one or more print heads 103. Alternatively or additionally, fresh climate control fluid 203 may be filled into the container 202 in order to flush ink from the container 202 via the drain 311, 321 after a cleaning process, and thus in order to clean the container 202.

In an exemplary embodiment, the cover 200 includes an applicator 305, for example a spray nozzle, that is configured to apply cleaning fluid onto the nozzle plates 160 for the cleaning of said nozzle plates 160 of the one or more print heads 103 while the nozzle plates 160 of the one or more print heads 103 are covered. For example, the cleaning fluid may be applied onto the nozzle plates 160 of the one or more print heads 103 before a wiping process. The quality of the cleaning of the nozzle plates 160 of the one or more print heads 103 may thus be further increased.

In an exemplary embodiment, cleaning fluid is used as a climate control fluid 203. The quantity of different fluids that are to be provided in a printer 100 may thus be reduced. Furthermore, an efficient and reliable cleaning of the interior of the container 202 of the cover 200 may thus be produced.

According to a further aspect, an inkjet printer 100 is described. The printer 100 includes at least one print head 103 having a nozzle plate 160 with at least one nozzle 21, 22 that is configured to eject ink droplets onto a recording medium 120 in order to print a print image onto the recording medium 120. Moreover, the printer 100 includes at least one cover 200 described in this document, which cover 200 is configured to cover and simultaneously clean the nozzle plate 160 of the print head 103 in a rest phase and/or in a parking or rest position.

In an exemplary embodiment, the controller 101 of the printer 100 may be configured to drive the print head 103 upward out of a printing position, orthogonal to the surface of a recording medium 120 to be printed to. Furthermore, it may be induced that the cover 200 is moved below the nozzle plate 160 of the print head 103. The print head 103 may then be lowered into the parking or rest position so that the nozzle plate 160 of the print head 103 is covered by the cover 200.

In an exemplary embodiment, to clean the nozzle plate 160 of the print head 103, the controller 101 is configured to activate a cleaning mechanism of the cover 200 while the print head 103 is located in the parking or rest position. To clean the nozzle plate 160, the print head 103 may be induced to eject ink via the one or more nozzles 21, 22 of the print head 103, meaning that a purging of the print head 103 may be induced. The ink may thereby be captured by the container 202 of the cover 200. Furthermore, an application means 305 may be induced to apply cleaning fluid onto the nozzle plate 160. Excess cleaning fluid may thereby be captured by the container 202 of the cover 200. A wiper carrier 303 may also be induced to direct a wiper 301 past the nozzle plate 160 in order to wipe off the nozzle plate 160, meaning in order to implement a wiping of the nozzle plate 160. The wiped-off ink may thereby be captured by the container 202 of the cover 200.

In an exemplary embodiment, the controller 101 is configured to discharge captured fluid from the container 202 of the cover 200 and/or admit new climate control fluid 203 into the container 202 following a cleaning process.

In an exemplary embodiment, the controller 101 is configured to transition the print head 103 from the rest or parking position back into the printing position. In an exemplary embodiment, the controller 101 includes processor circuitry that is configured to perform one or more functions and/or operations of the controller 101, such as controlling the movement of the print head 103 and/or cover 200, activating a cleaning mechanism of the cover 200, and/or controlling the removal and/or supply of fluid to the container 202.

FIG. 4 shows a workflow diagram of a method 400 for cleaning the nozzle plate 160 of at least one print head 103 of an inkjet printer 100 according to an exemplary embodiment. In an exemplary embodiment, the method 400 includes the covering 401 of the nozzle plate 160 with a cover 200 in order to delay a drying of ink in the print head 103. The nozzle plate 160 may thereby be covered by the cover 200 in a parking or rest position of the print head 103 above the surface of a recording medium 120 to be printed to. In an exemplary embodiment, the method 400 further includes the cleaning 402, in particular the wiping, of the nozzle plate 160 while the nozzle plate 160 is covered by the cover 200. The cleaning may thereby take place via a cleaning mechanism, in particular via a wiper 301, of the cover 200. The cleaning mechanism may in particular be arranged in a container 202 of the cover 200 by which the nozzle plate 160 is covered.

The aspects described in the present disclosure enable the installation space of a printer 100 to be significantly reduced (for example by 30% or more) via the omission of a separate cleaner 150. Furthermore, the costs are reduced via the omission of a horizontal drive and of mechanisms connected therewith. Moreover, the movement times of the print heads 103 of a printer 100 may be reduced, such that a reduced drying of the ink in the print head 100 takes place between cleaning and printing. Furthermore, the servicing requirements in the maintenance and cleaning of a cleaner 150 and the parking hatch 200 may be reduced via the described measures, in particular since the adhesion of the ink to a parking hatch 200 may be reduced due to the interaction with the cleaning fluid used as a climate control fluid 203. The filling of the container 202 of a parking hatch 200 with demineralized water as a climate control fluid 203 may thus be omitted. Moreover, the cleaning of a separate purging basin in a cleaner 150 is dispensed with.

Conclusion

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, a programmable processing circuit, other structural electronic hardware, or a combination thereof. A processor includes a microprocessor, a digital signal processor (DSP), central processor (CPU), application-specific instruction set processor (ASIP), graphics and/or image processor, multicore processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
2 movement direction (of a print bar)
21, 22 nozzle
31, 32 column (of the print image)
100 printer
101 controller
102 print bar
103 print head
120 recording medium
150 cleaner
151 wiper
160 nozzle plate
200 cover (parking hatch)
201 rotation axle
202 container
203 climate control fluid
204 opening
205 wall segment
211 rise direction
212 rotation direction
213 fall direction
301 wiper
302 guide rail
303 wiper mount
305 application means
311 drain/spillover opening
312 drain line
321 drain
322 inlet
323 drain valve
400 method for cleaning the nozzle plate of a print head
401-402 method operations

The invention claimed is:

1. A cover for covering a nozzle plate of a print head of an inkjet printer, comprising:

a container configured to house a climate control fluid, the container including an opening that is configured:

to receive the climate control fluid into an interior of the container to generate a microclimate for the nozzle plate to delay a drying of ink in the print head in comparison to an instance in which the nozzle plate is exposed to an ambient air of the printer, the climate control fluid being different than the ink in the print head;

to receive the nozzle plate directed into the container via the opening to cover the nozzle plate by the container; and such that the nozzle plate seals the opening of the container in a fluid-tight manner while the nozzle plate is arranged in the opening of the container; and a wiper configured to be directed past the nozzle plate of a print head while the nozzle plate is arranged in the opening of the container to wipe ink off the nozzle plate and into the container.

2. The cover according to claim 1, further comprising:

at least one guide rail; and a wiper mount to which the wiper is fixed, the wiper mount being configured to travel along the guide rail and past the nozzle plate within the container.

3. The cover according to claim 2, wherein the container comprises a drain via which the climate control fluid may be drained out of the interior of the container.

4. The cover according to claim 3, wherein the container comprises an inlet via which the climate control fluid may be provided into the interior of the container.

5. The cover according to claim 2, wherein the container comprises an inlet via which the climate control fluid may be provided into the interior of the container.

6. The cover according to claim 2, wherein:

the container is configured to be pivoted toward the print head or away from the print head about a rotation axle; and the container of the cover includes a wall segment to one side of the opening that is configured to form a basin configured to receive the climate control fluid when the container is pivoted away from the print head.

7. The cover according to claim 1, further comprising an applicator that is configured to apply cleaning fluid to the nozzle plate to clean the nozzle plate while the nozzle plate is covered.

8. The cover according to claim 1, wherein the climate control fluid is a cleaning fluid.

9. The cover according to claim 1, wherein the container comprises a drain via which at least a portion of the climate control fluid and the ink wiped off the nozzle plate may be drained out of the interior of the container.

10. The cover according to claim 1, further comprising an applicator configured to apply a portion of the climate control fluid to the nozzle plate to clean the nozzle plate while the nozzle plate is covered.

11. The cover according to claim 10, wherein the wiper is configured to wipe off at least some of the climate control fluid applied to the nozzle plate and the ink on the nozzle plate from the nozzle plate and into the container.

12. The cover according to claim 10, wherein the climate control fluid is a cleaning fluid.

13. An inkjet printer, comprising:

a print head having a nozzle plate with at least one nozzle configured to eject ink droplets onto a recording medium to print a print image onto the recording medium in a first mode of operation;

a cover configured to cover and simultaneously clean the nozzle plate of the print head in a second mode of operation, the cover including:

a container configured to house a climate control fluid, the container including an opening that is configured:

to receive the climate control fluid into an interior of the container to generate a microclimate for the nozzle plate to delay a drying of ink in the print head in comparison to an instance in which the nozzle plate is exposed to an ambient air of the printer, the climate control fluid being different than the ink in the print head;

to receive the nozzle plate directed into the container via the opening to cover the nozzle plate by the container; and such that the nozzle plate seals the opening of the container in a fluid-tight manner while the nozzle plate is arranged in the opening of the container; and a wiper configured to be directed past the nozzle plate of a print head while the nozzle plate is arranged in the opening of the container to wipe ink off the nozzle plate and into the container.

* * * * *